US007722181B2

(12) United States Patent
Don et al.

(10) Patent No.: US 7,722,181 B2
(45) Date of Patent: May 25, 2010

(54) POWER FEED BAG PRINT SYSTEM

(75) Inventors: David Don, Bethesda, MD (US); Daryl Betton Turner, Laurel, MD (US); Edward Reagan, McLean, VA (US)

(73) Assignee: RSI Systems, LLC, Gaithersburg, MD (US)

( * ) Notice: Subject to any disclaimer, the term of this patent is extended or adjusted under 35 U.S.C. 154(b) by 146 days.

(21) Appl. No.: 11/518,960

(22) Filed: Sep. 12, 2006

(65) Prior Publication Data

US 2007/0222803 A1 Sep. 27, 2007

Related U.S. Application Data

(60) Provisional application No. 60/786,845, filed on Mar. 25, 2006.

(51) Int. Cl.
*B41J 2/01* (2006.01)

(52) U.S. Cl. ..... 347/104

(58) Field of Classification Search ..... 347/104
See application file for complete search history.

(56) References Cited

U.S. PATENT DOCUMENTS

| | | | | |
|---|---|---|---|---|
| 5,049,030 | A * | 9/1991 | Lockert | 414/788.7 |
| 5,088,848 | A * | 2/1992 | De Falco et al. | 400/630 |
| 6,695,445 | B2 * | 2/2004 | Hagstrom et al. | 347/104 |
| 7,086,793 | B2 * | 8/2006 | Miyazaki | 400/76 |

* cited by examiner

*Primary Examiner*—Matthew Luu
*Assistant Examiner*—Brian J Goldberg
(74) *Attorney, Agent, or Firm*—Herman Hohauser

(57) ABSTRACT

A custom designed drive mechanism to be utilized in conjunction with an ink jet printer having a motor, transmission, and gripping apparatus to transmit articles of manufacture to be printed upon through an enclosure having a linear bearing and spring system, an optical sensor, digital encoder and print mechanism such that the articles of manufacture travel in a single direction.

1 Claim, 13 Drawing Sheets

POWER FEED BAG PRINT SYSTEM

CROSS REFERENCE TO RELATED PATENT APPLICATION

This Application is related to and claims the benefit under 35USC 119(e) for the Provisional Patent Application of the same title having Ser. No. 60/786,845 filed on Mar. 25, 2006.

FIELD OF THE INVENTION

This invention relates to ink jet printing. More specifically, the invention pertains to a system that uses ink jet printers in conjunction with a custom drive mechanism for the purpose of printing on one or both sides of the top portion of filled and sealed feed, seed and related product bags.

BACKGROUND OF THE INVENTION

Ink Jet printing is a common method of non-impact printing. An ink jet printer emits intermittent streams of ink droplets from tiny nozzles in response to received electrical signals. The present invention is applicable to all types of ink jet printers.

When used in industrial applications, specifically as it pertains to the printing of text, graphics or barcodes on feed, seed or similar product bags, conventional ink jet printers suffer from a variety of drawbacks and disadvantages. For example, when an ink jet print head becomes damaged the printing process must be stopped until inventive device 100 can be restored to proper operational status. For systems that contain fixed print heads this means that that an operator has to stop an assembly line and physically disconnect an ink jet printer from its ink supply and mounting so that it can be removed for maintenance. This is a time consuming and often expensive process, both in terms of the lost production stemming from a shut down line and the maintenance costs associated with servicing the print head.

In addition to the above, it is advantageous to incorporate both feed and print mechanisms in one unit. Having separate feed and printing mechanism can cause distortion in the print quality resulting from mismatched feed and print rates. Print quality is also compromised by warping, slippage, or buckling of bag 200 by the print handler.

Moreover, print quality due to "stitching", a condition that occurs when overlapping print nozzles are not coplanar, is often un-adjustable or, if it can be adjusted it requires special tools to do so. Stitching results in a visible gap in between print produced by multiple print heads. The advantage of an adjustment mechanism to eliminate this condition is that overall print resolution increases as well as the number of applications that the printer may be used for. For example, very course inconsistent print may be acceptable for printing bar codes on feed bags, but stitching may prevent the inclusion of fine text or graphics.

Many existing industrial printers are not designed to print on both sides of bag 200 simultaneously.

Industrial ink jet applications require specialized ink delivery systems. To overcome the shortcomings of existing ink jet industrial print systems, a customized feed mechanism and print head system is provided. The first object of the invention is to provide even and uniform transport of bag 200 through a printing system. A related object is to link the feed mechanism to a closed loop system wherein the print speed may be matched to the speed in which the transport mechanism is operating. Another object of the invention is to provide transport for print mediums, such as bag 200, of various thicknesses. It is yet another object of the invention to incorporate mechanisms that serve to eliminate stitching quickly and without the use of tools. It is still another object of the invention to enable the quick tool-less replacement of print heads. Another object of the invention is to place print accurately and repeatedly at a predetermined distance from the leading edge of bag 200. Lastly, it is an object of this invention to place print on two sides of bag 200 simultaneously.

SUMMARY OF THE INVENTION

It is to be understood that both the foregoing and general description and the following detailed description are exemplary, but are not restrictive, of the inventive device 100. In accordance with the principles of the present invention, a print system includes a printer and material handler. As illustrated in FIG. 1, the inventive device 100 consists of six main components: a motor and drive system 101, a mechanical enclosure 102, a linear bearing and spring system 103, an optical sensor 104, a digital encoder (not visible) 105, and a print mechanism 106. Inventive device 100 is designed to operate with product traveling in only one direction and to place ink jet print on section 203 of bag 200, shown in FIG. 13.

Mechanical enclosure 102 encloses print and drive mechanisms 106, and serves to attach the system to an external support member. Mechanical enclosure 102 is made up of two halves which are joined by the linear bearing and spring assembly 103 and a drive system 101. Inlet guides at the front of mechanical enclosure 102 funnel bag 200 into a channel defined by the separation between the two halves of mechanical enclosure 102. On each side of mechanical enclosure 102 a door 19 allows access to a print mechanism 106.

Linear bearings and spring assembly 103 connect the two sides of mechanical enclosure 102 and allow for a variety of print medium, such as bag 200 thicknesses, such as portion 203 of bag 200, shown in FIG. 13.

The entry of section 203 of bag 200 into the inventive device 100 breaks a beam of light provided by optical sensor 104 slightly offset from the portion of mechanical enclosure 102 directly in front of the inlet guides 12, shown in FIG. 6. This entry action triggers the start of a print operation.

A drive mechanism consisting of motor 56, transmission 800 and four knurled 16 wheels firmly and securely transport bag 200 through the inventive device for the purpose of printing. The wheels are opposed such that they "pinch" bag 200 for transport free of slippage, warpage or buckling of bag 200.

Attached to one of the drive wheels inside mechanical enclosure 102 is digital encoder 96 that constantly monitors the speed of the wheels and bag 200.

Print mechanism 106 consisting of an ink jet printer assembly and adjustment knobs 58A and 58B applies print on section 203 of bag 200, shown in FIG. 13, as it passes through the system. Print mechanism 106 contains overlapping print cartridges, wherein each individual cartridge can print a set print height. By ganging multiple print cartridges, the system can print up to two inches of print height. Adjustment knobs 58A and 58B are used to raise or lower the print height relative to the feed bag's stitching and to position the print heads so that overlapping ganged print cartridges are coplanar.

DETAILED DESCRIPTION OF THE INVENTION

Figure 1:
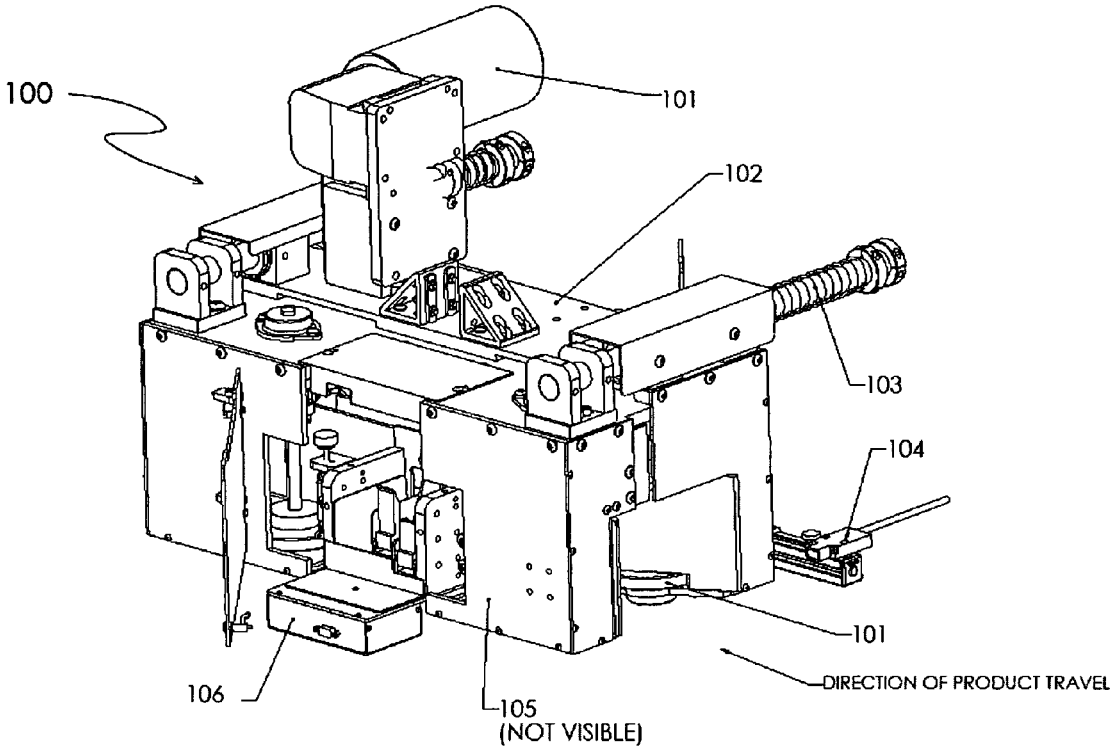
FIG. 1 is an isometric view of the complete inventive device 100 with the access doors 19 open revealing a print head 106 on the inside of inventive device 100.

For simplicity and illustrative purposes, the principles of the present invention are described by referencing mainly to an exemplary embodiment thereof, particularly with references to an example of the inventive device 100. However, one of ordinary skill in the art would readily recognize that the same principles are equally applicable to, and can be implemented in, any device designed to print on feed or seed bags or similar printing mediums.

Referring to all the drawings, it is to be understood that, according to common practice, the various components of the drawing may or may not be to scale. Reference numerals refer to components throughout the drawings, however, different drawings may not have common numerical references.

As illustrated in FIG. 1, the inventive device 100 consists of six main components: a motor and drive system 101, a mechanical housing 102, a linear bearing and spring system 103, an optical sensor 104, a digital encoder (not visible) 105, and a print mechanism 106. The system is designed to operate with print medium traveling in one consistent direction.

Figure 13:
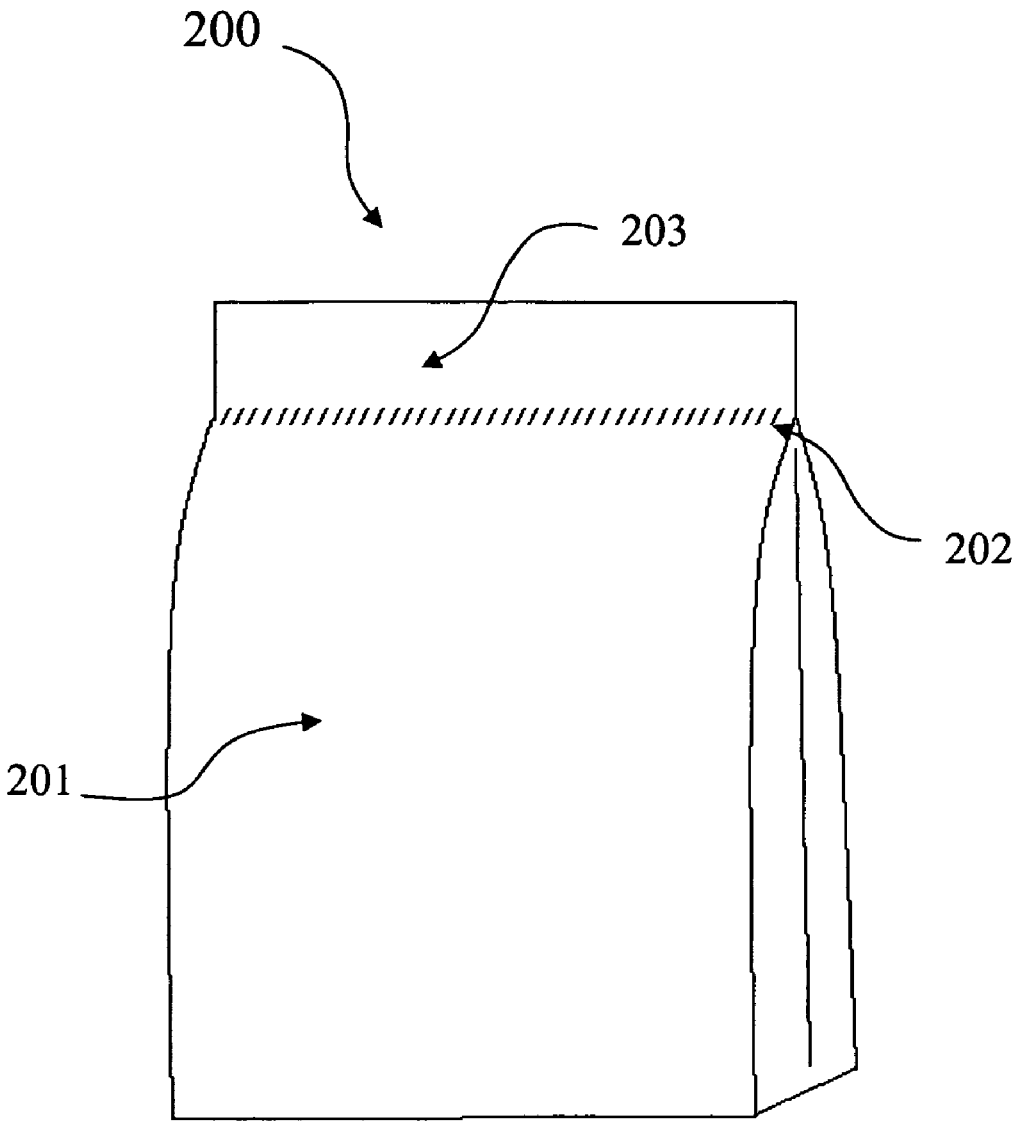
FIG. 13 is an isometric rendering of the preferred embodiment of bag 200, a bag containing animal feed material. This figure shows the bag's stitching and the effective print area as it pertains to the inventive device 100.

The object of the inventive device 100, as it pertains to FIG. 13, is to place print, by way of an ink jet printing process, on print medium. In the preferred embodiment the print medium is section 203 of bag 200, a product bag containing grain feed material, however, it is to be understood that the inventive device 100 shall not be restricted to printing on bags, and may be used to print on a variety of print mediums. With further respect to FIG. 13, section 202 is a stitching element used to isolate the fill material in bag 200 from the section 203. Section 201 contains bag 200 filler material.

Figure 2:
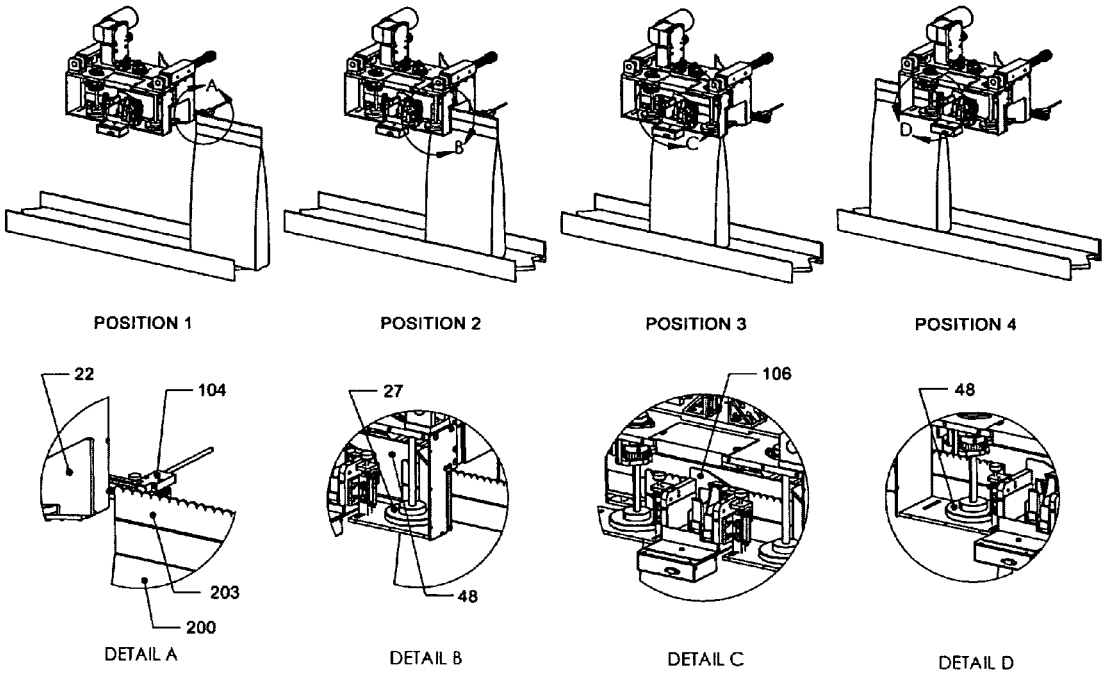
FIG. 2 contains several isometric views for the purpose of sequentially illustrating how bag 200 travels through the inventive device 100 during the printing process.

Referring to FIG. 2, the printing on bag 200 as depicted in FIG. 2, occurs in four fundamental steps. Note that several components have been hidden from view so as to expose the inner mechanics of inventive device 100 for the purpose of detailing the sequential steps involved in the operation. In addition, no structural support members are shown supporting inventive device 100.

Position 1, Detail A shows bag 200 traveling down an assembly line (not labeled) which passes in front of the optical sensor 104. At this time the optical sensor 104 detects the leading edge of the bag 200. This triggers an external control device (not shown) to start a printing process as bag 200 reaches skid plates 12.

Position 2, Detail B shows skid plates 12 channeling bag 200 between skid tractors 48 where it is picked up by in-feed knurled wheels 27 and fed through the system at a uniform rate of speed. In-feed knurled wheels 27 grab bag 200 and pull it into the print area at a manually set speed. The incompressible nature of bag 200 forces the two halves of inventive device 100 to separate by the thickness of bag 200 thusly increasing the force on the tension springs 34 (not shown). The increased tension pinches bag 200 between in-feed knurled wheels 27 resulting in smooth controlled transport through inventive device 100 without slippage, warping or buckling.

Position 3, Detail C shows how printing occurs when the leading edge of bag 200 reaches a certain distance from the front of print head 106. Distance is calculated using the information from optical sensor 104 in conjunction with the velocity of bag 200 obtained from encoder 96 (not shown).

Position 4, Detail D shows exit-feed knurled wheel 48 pulling bag 200 through inventive device 100. The combination of the in-feed and exit-feed wheels knurled wheels 48, hold bag 200 securely without slippage, warping, or buckling during the printing process.

Figure 3:
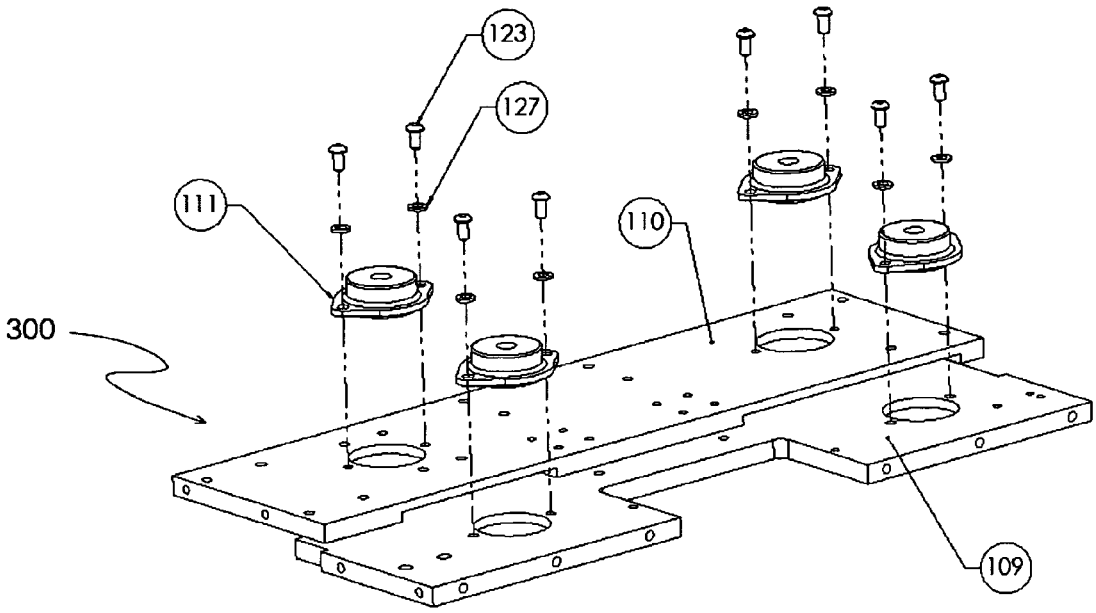
FIG. 3 is an isometric view showing the metal top plates of the assembly.

FIG. 3 shows sub-assembly 300 which forms the top of mechanical enclosure 102 of FIG. 1. Sub-assembly 300 consists of two independent metal plates—upper plate dummy 110 and upper plate 109 each containing two rigidly attached flange-mount bearings 111. Flange-mount bearings 111 mount on the outside of inventive device 100 on upper plate dummy and upper plate, 110 and 109 respectively, via #4-40 screws 123 for quick replacement or service.

Figure 4:
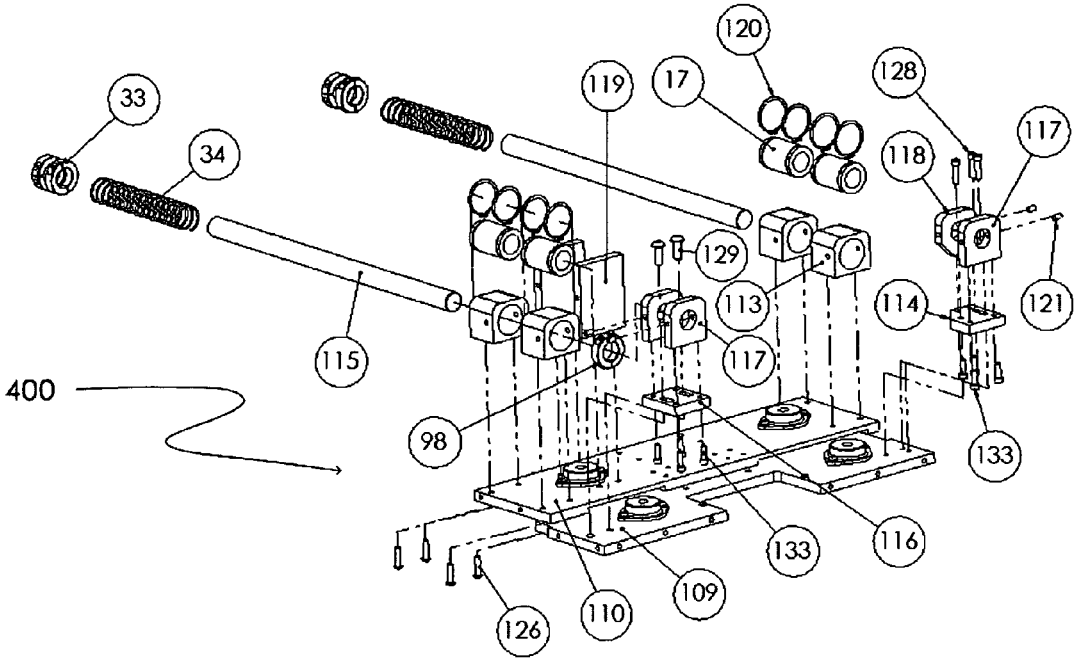
FIG. 4 is an isometric view showing a sub-assembly consisting of top metal plates and a linear bearing assembly.

FIG. 4 demonstrates how sub-assembly 300, shown in FIG. 3, joins with linear bearing assembly 103, shown in FIG. 1, to form sub-assembly 400. Shafts 115 and linear bearings 113 join the two halves of mechanical enclosure 102, shown in FIG. 1. Shafts 115 are rigidly attached to upper plate dummy 110 via bar block a 117 and block c 118 using set screws 121. Linear bearings 17 are secured in blocks b 113 by retaining rings 120 and blocks b are rigidly attached to upper plate 2. Linear bearing assembly 103 allows upper plate 109 and upper plate dummy 110 to translate in one horizontal axis relative to upper plate dummy 110. Two springs 34 compress upper plate dummy 110 and upper plate 109 together such that they provide positive force on bag 200 as it travels through inventive device 100, and may expand or contract to accommodate various thicknesses of section 203 of bag 200, shown in FIG. 13. Spring tension may be increased by moving two collars 98 on the end of each shaft inwards. The use of a single adjustable spring collar 98 on the portion of shaft 115 located between block b 118 and bar block a 117 controls the minimum distance between the two halves of assembly 400.

Figure 5:
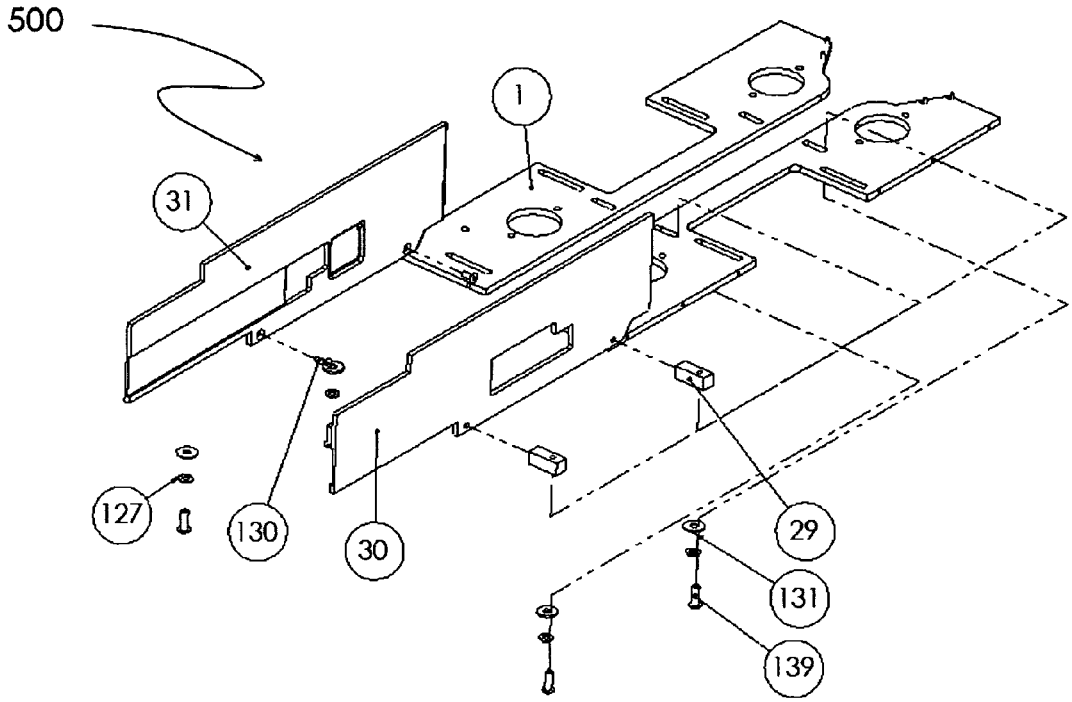
FIG. 5 is an isometric view illustrating how the product skids mate to the bottom plates. This view is also used to illustrate the path in which bag 200 travels and where the ink jet print heads protrude for printing.

FIG. 5 shows sub-assembly 500 which forms the bottom of mechanical enclosure 102, shown in FIG. 1, and a product guide for section 203 of bag 200, shown in FIG. 13. Holes in skid tractors 30 and 31 allow for the passage of print heads 106, shown in FIG. 1, wherein they come in contact with section 203 of bag 200, shown in FIG. 13, as it passes between skid tractors 30 and 31 during a printing operation. Skid tractors 30 and 31 are constructed of anodized aluminum. Although it is not shown an optional feature may include extending the height of skid tractors 30 and 31 to allow for additional print mechanism 106, shown in FIG. 1, adjustment in the vertical direction. In addition, this would allow for the inclusion of additional print cartridges (not shown) required to produce additional print height.

Figure 6:
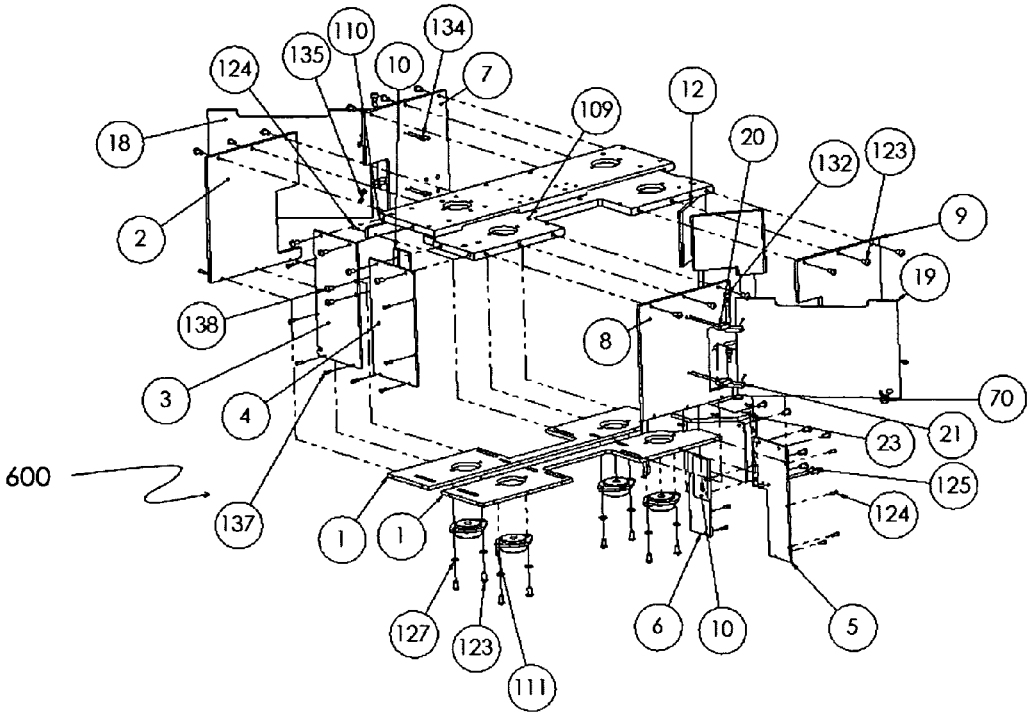
FIG. 6 is an isometric view showing how various sheet metal components join to compose a frame.

FIG. 6 demonstrates how mechanical enclosure 102, shown in FIG. 1, is made up of two part mechanical enclosure 600. Two part mechanical enclosure 600 is constructed of several rigidly attached metal plates: 2, 7, 8, 9, 3, 4, 1. Upright metal plates 2, 7, 8 and 9 serve to protect inventive device's 100 electronics and transmission mechanisms while doors 18 and 19 allow for restricted access to sub assemblies 106, shown in FIG. 1, on both sides of inventive device 100. Bag 200 enters two part mechanical enclosure 600 from product inlet guides 12 which compensate for a range of alignment of bag 200 on the assembly line (not shown) by funneling section 203 of bag 200 into inventive device 100. The Tractor Frame halves 1 contain flange mount bearings 111 that mirror the placement of those on the Upper Plate 110 and upper plate dummy 109. Doors 18 and 19 are secured by turn pawl latches 70 to the large uprights 2 and 9. Although not shown in this assembly, it is possible to incorporate an optional power cut-off such that power to inventive device 100 is terminated when the doors 18 and 19 are opened.

Figure 7:
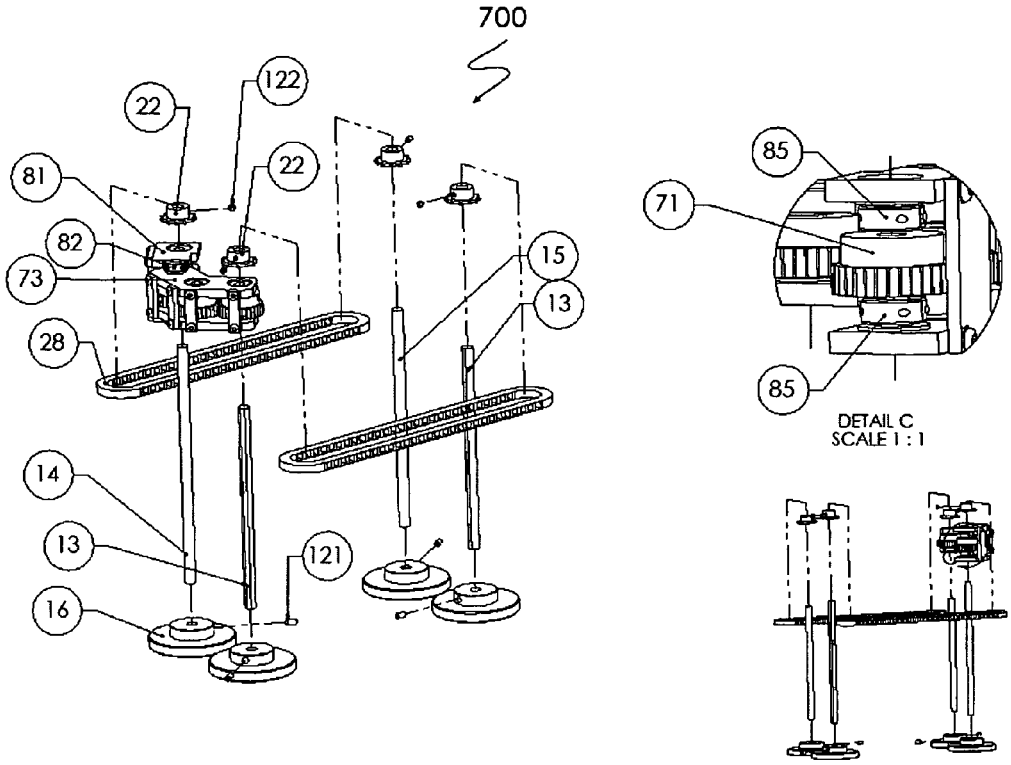
FIG. 7 contains two isometric views of the drive wheels, shafts and transmission as well as a detailed view of a transmission component.

FIG. 7 shows drive system 700 used to pull section 203 of bag 200 through inventive device 100. Tractor long shaft 14, tractor medium shaft 13, and tractor short shafts 13 and 15 mate with the upper most and lower most portions of the mechanical enclosure 102, shown in FIG. 1. Four knurled wheels 16, tractor long shaft 14 and tractor medium shaft 13 evenly transmit power to both sides of inventive device 100 for the purpose of transporting print material through inventive device 100 without slippage, warping or buckling of bag 200. Mechanical power is input in tractor long shaft 14. Gear 22 attaches to the top of tractor long shaft 14 and transfers power to another gear 22 attached to the top of tractor medium shaft 13 via chain 28. The two knurled wheels 16 attached at the bottom of long and medium shafts, 14 and 13 respectively, rotate at the same speed and in the same direction. Transmission 800, shown in FIG. 8 takes the power input from tractor long shaft 14 and transfers equal and opposite power to knurled wheels 16 on the other side of inventive device 100 such that knurled wheel 16 attached to tractor short shafts, 13 and 15 respectively, rotate at the same speed but in the opposite direction of knurled wheels 16 attached to tractor long 14 and medium shafts 13. Knurled wheels 16 pull bag 200 through inventive device 100 at a constant and controlled rate of speed so that even and consistent printing can occur. Knurled wheels 16 are fixed such that slots in skid tractors, 30 and 31, shown in FIG. 5, can not move in the vertical direction. However, inventive device 100 may be modified such that knurled wheels 16 may be made fully adjustable in the vertical direction in order to move within the extents of section 203 of bag 200.

Figure 8:
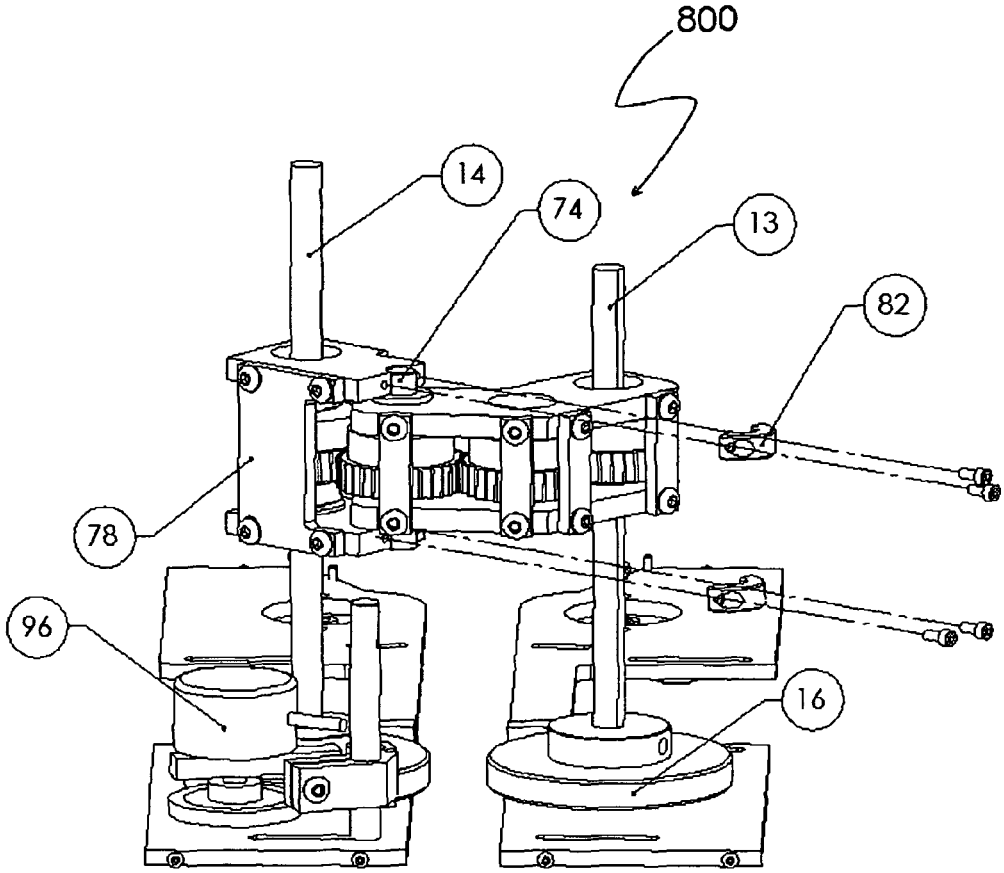
FIG. 8 is a front-top view of the transmission sub-assembly and two front wheels and encoder used for the purpose of illustrating the relationship of the various components.

FIG. 8 shows gearbox assembly 800, which consists of two halves connected via shaft 74. Gearbox assembly 800 resides on the inside of mechanical enclosure 102, shown in FIG. 1. In addition to connecting the two halves of gearbox assembly 800, shaft 74 and two collars with screws 105 also connect the two halves of mechanical housing 102 Gearbox assembly 800 pivots around tractor short shaft 13, tractor long shaft 14 and shaft 74. This movement allows four knurled wheels 16 to expand or contract depending on the thickness of bag 200 passing through inventive device 100.

Figure 9:
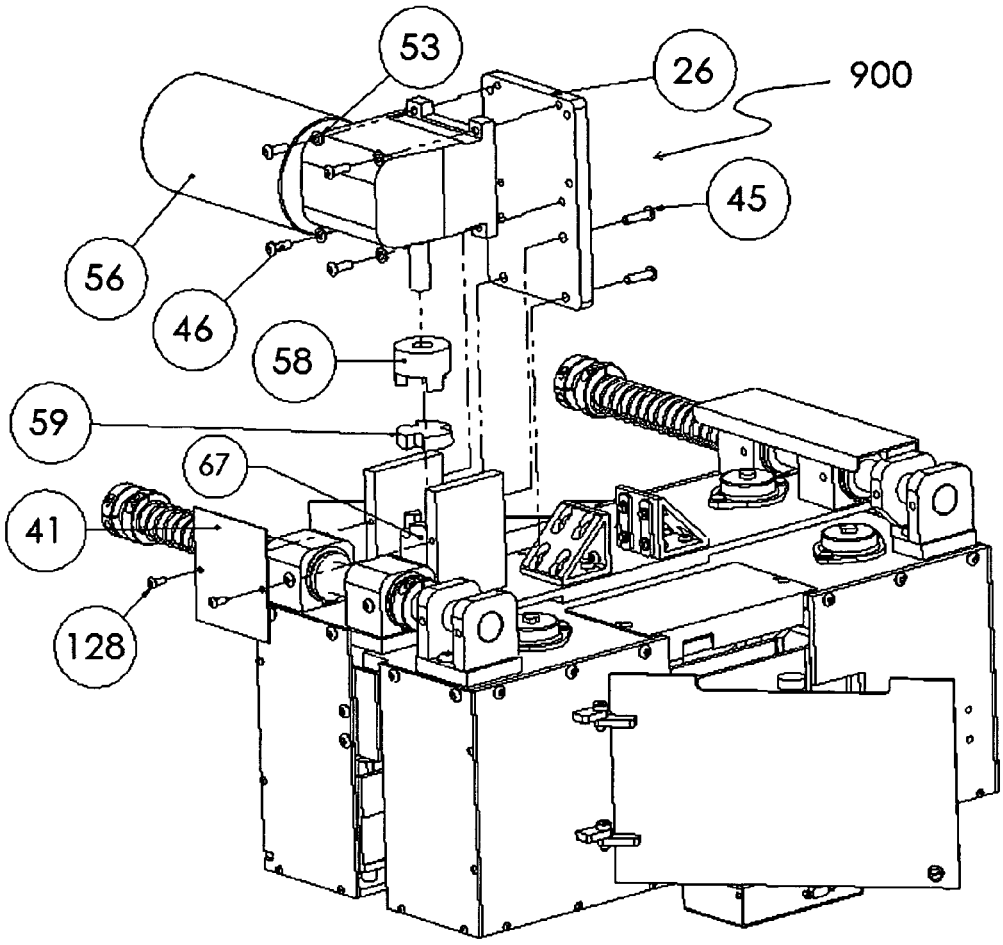
FIG. 9 is an isometric view showing the interface of the drive motor sub-assembly with inventive device 100.

FIG. 9 shows sub-assembly 900 which consists of motor and transmission 56, which is rigidly attached to inventive device 100 by motor mount 26. Power is transmitted from motor and transmission 56 through Lovejoy Jaw Type Coupling 58, 59, and 67 first to tractor long shaft 14, shown in FIG. 8, and thusly all four knurled wheels 16 (also not visible in this drawing). The power transmission area is enclosed with metal cover 41 to shield the rotating elements. Motor and transmission 56 operate at a continuous speed, however, inventive device 100 may be controlled by an external mechanism such that motor and transmission 56 speed may be adjusted to dynamically compensate for corresponding changes in the assembly line speed.

Figure 10:
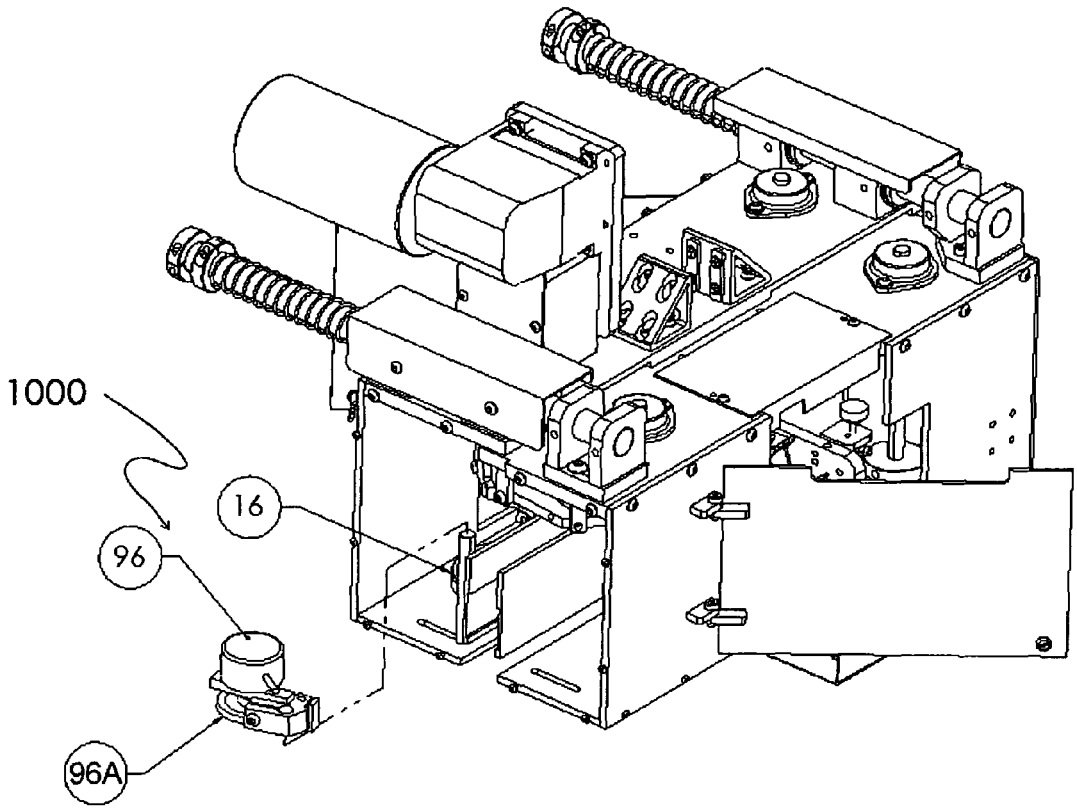
FIG. 10 is an isometric view highlighting the digital encoder sub-assembly.

FIG. 10 shows sub-assembly 1000 which consists friction drive incremental encoder 96. Friction drive incremental encoder 96 makes direct contact with in-feed knurled wheel 16 via encoder wheel 96A. Encoder 96 is used to determine the speed of bag 200. This information is required for proper printing in that the ink jet print speed must be precisely matched to the speed of bag 200. Encoder 96 enables inventive device 100 to accommodate a range of print material speeds, and make dynamic adjustments to the rate of print in the event that bag 200 changes speed as it travels through inventive device 100 during the print process.

Figure 11:
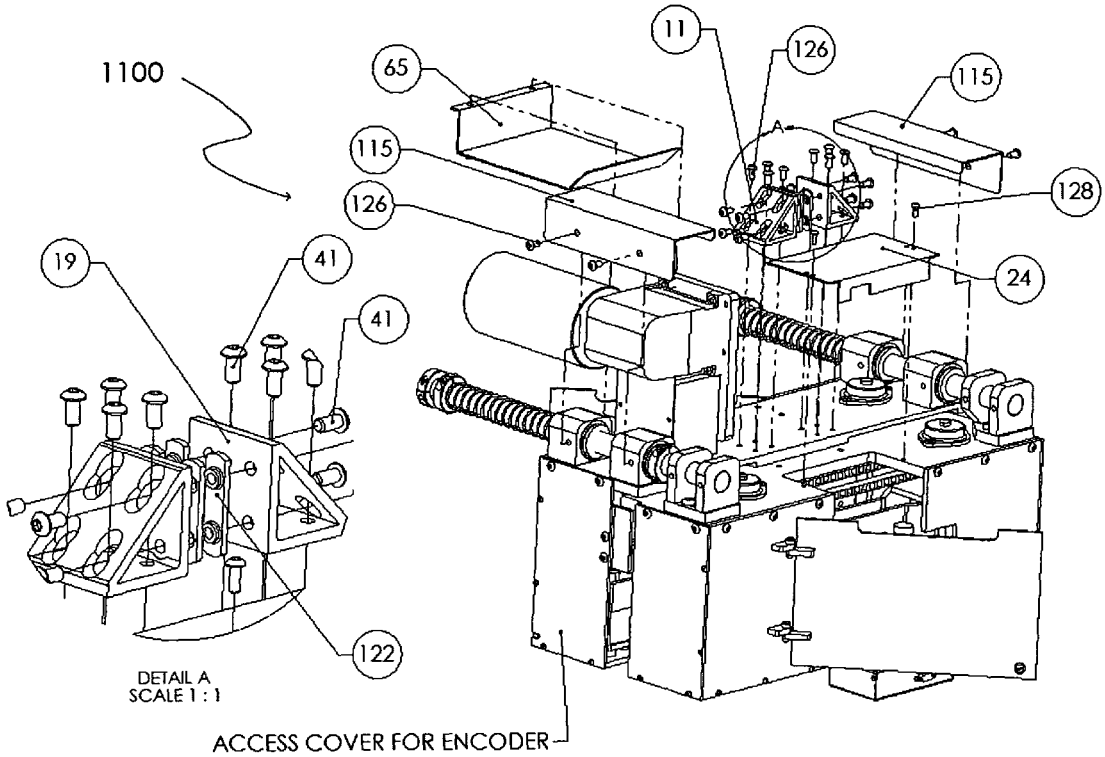
FIG. 11 is an isometric view showing several sheet-metal components and a detailed view of a component used to adapt inventive device 100 to an external member. Reference is also made to show where the digital encoder sub-assembly is located within inventive device 100.

FIG. 11 shows sub-assembly 1100 consisting of covers 65, 115 and 24 used to shield the assembly mechanics, and angle mount brackets 2 used to mount the entire assembly to an external fixture. Angle mount brackets 19 securely attach the assembly to a 2" square slotted aluminum extrusion (not shown) via four double t-nuts 122 and eight ¼-20 screws 41.

Figure 12:
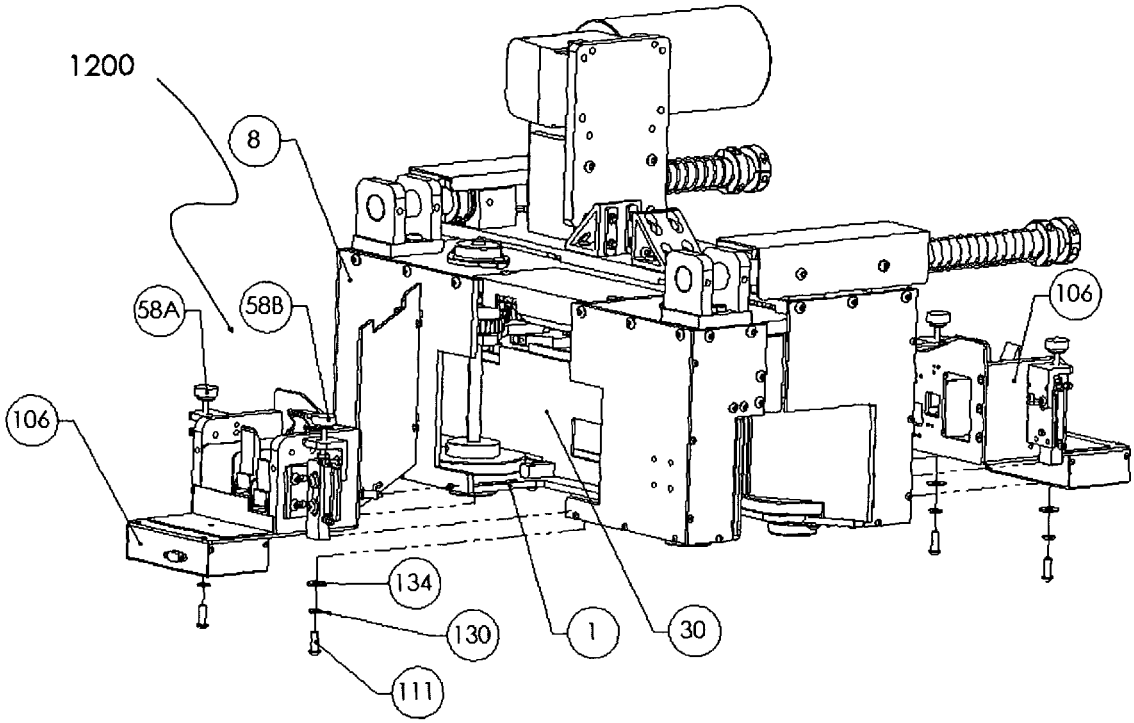
FIG. 12 is an isometric view highlighting the print head sub-assembly, the print head adjustment mechanisms and how the sub-assembly mates with the inventive device.

FIG. 12 shows sub-assembly 1200, consisting of two print mechanisms 106. Each print mechanism 106 contains four print cartridges (not shown) each capable of producing a half-inch of print height. It should be noted that inventive device 100 contains two print mechanism 106 with four print cartridges (not shown) each for a maximum printing height of two inches. Moreover, employing two print mechanisms 106 enables inventive device 100 to print on both sides of bag 200 simultaneously. Print mechanism 106 may print characters, images or both. By increasing the number of print cartridges (not shown) in print mechanism 106, the print height may be increased. There is no limit to the number of print cartridges (not shown) that may be used in inventive device 100.

Each print mechanism 106 secures to one side of tractor frames 1 via two ¼-20 screws 111. Print mechanism's 106 face (not visible) installs snugly against tractor skids 30. Printing occurs through the open areas in tractor skids 30, wherein ink jet nozzles on the print cartridge (not visible) face extend through the hole in tractor skids 30 such that they protrude until they are approximately flush with the inside surface of tractor skids 30. Note that tractor skids 30 guide bag 200 as it travels through inventive device 100 during the printing operation.

Print height adjustment as well as calibration required to eliminate "stitching", a condition that occurs when overlapping print nozzles are not coplanar, is accomplished by adjusting knobs 58A and 58B. Turning knobs 58A and 58B in the same direction allow print mechanism 106 to be raised or lowered +/−⅛", or, by turning knobs 58A and 58B in opposing directions print mechanism 106 can be rotated +/−5° around the axis normal to the print plane. The latter adjustment compensates for misalignment by allowing print mechanism 106 to be rotated such that overlapping ink jet nozzles become coplanar, thusly eliminating stitching. Although not shown, an optional power assisted print head adjustment mechanism may replace manual knobs 58A and 58B. Additionally, a closed-loop feedback system may be used for automatic alignment of the print nozzles for the purpose of eliminating the stitching condition.

The invention claimed is:

1. A method of applying printing to each of a plurality of moving non-planar sealed packages each containing a usable substance and having printing surfaces of varying thickness utilizing a print system having a drive system and a print mechanism with multiple print heads including the steps of:

providing a plurality of non-planar sealed packages each containing a usable substance and having two printable surfaces separated by varying thicknesses, transporting said packages one-at-a time in a non-touching relationship towards said printing mechanism, gripping two sides of each said packages as it passes said printing mechanism, providing an adjustable housing being controlled by a linear bearing assembly to accommodate the adjustment of the position of said printing mechanism in response to the thickness of said printing surface of each of said packages, and printing the desired information on both sides of the two-sided printing surface as it passes by said printing mechanism.

* * * * *